US009169601B2

(12) United States Patent
Helgesen et al.

(10) Patent No.: US 9,169,601 B2
(45) Date of Patent: Oct. 27, 2015

(54) METHOD FOR FORMING AN ANISOTROPIC CONDUCTIVE PAPER AND A PAPER THUS FORMED

(75) Inventors: Geir Helgesen, Finstadjordet (NO); Matti Knaapila, Drammen (NO); Mark Buchanan, Oslo (NO)

(73) Assignee: CONDALIGN AS, Kjeller (NO)

( * ) Notice: Subject to any disclaimer, the term of this patent is extended or adjusted under 35 U.S.C. 154(b) by 0 days.

(21) Appl. No.: 13/994,143

(22) PCT Filed: Dec. 14, 2011

(86) PCT No.: PCT/NO2011/000344

§ 371 (c)(1),
(2), (4) Date: Jun. 14, 2013

(87) PCT Pub. No.: WO2012/081991

PCT Pub. Date: Jun. 21, 2012

(65) Prior Publication Data

US 2013/0264019 A1 Oct. 10, 2013

(30) Foreign Application Priority Data

Dec. 15, 2010 (NO) ..... 20101760

(51) Int. Cl.
*D21H 25/04* (2006.01)
*D21H 13/48* (2006.01)
(Continued)

(52) U.S. Cl.
CPC ..... *D21H 25/04* (2013.01); *D21H 13/46* (2013.01); *D21H 17/03* (2013.01); *D21H 17/67* (2013.01);
(Continued)

(58) Field of Classification Search
CPC ..... D21H 13/46; D21H 13/48; D21H 13/50; D21H 17/03; D21H 17/67; D21H 19/06; D21H 19/385; D21H 25/04; D21H 21/14; H01B 1/24
USPC ..... 162/100, 102, 135–136, 138, 192, 162/181.1, 181.4, 181.9, 183–184
See application file for complete search history.

(56) References Cited

U.S. PATENT DOCUMENTS 852,918 A * 5/1907 White ..... 162/138
2,374,214 A * 4/1945 Mobius et al. ..... 162/138
(Continued)

FOREIGN PATENT DOCUMENTS

DE 29 49 899 6/1981
GB 927115 * 5/1963
(Continued)

OTHER PUBLICATIONS

Machine Translation of DE 2949899, published on Jun. 19, 1981.*
(Continued)

*Primary Examiner* — Jose Fortuna
(74) *Attorney, Agent, or Firm* — Oblon, McClelland, Maier & Neustadt, L.L.P.

(57) ABSTRACT

A method for treating a paper to provide at least a part of it with anisotropic electric conductivity, by i) applying to the paper a dispersion comprising a non-aqueous, liquid dispersing agent and conductive particles, ii) applying an electric field over at least part of the paper, so that a number of the conductive particles are aligned with the field, thus creating conductive pathways, and wholly or partially eliminating the dispersing agent and allowing the paper to dry thereby stabilizing and preserving the conductive pathways in the paper as well as paper so produced. The paper may alternatively be prepared from a cellulose dispersion comprising conductive particles and subjecting the dispersion for similar aligning of the conductive particles.

35 Claims, 2 Drawing Sheets

(51) Int. Cl.

| | |
|---|---|
| ***D21H 17/03*** | (2006.01) |
| ***D21H 17/67*** | (2006.01) |
| ***D21H 19/06*** | (2006.01) |
| ***D21H 21/14*** | (2006.01) |
| ***H01B 1/24*** | (2006.01) |
| ***D21H 13/46*** | (2006.01) |
| *D21H 13/50* | (2006.01) |
| *D21H 19/38* | (2006.01) |

(52) U.S. Cl.
CPC ..... *H01B 1/24* (2013.01); *D21H 13/48* (2013.01); *D21H 13/50* (2013.01); *D21H 19/06* (2013.01); *D21H 19/385* (2013.01)

(56) References Cited

U.S. PATENT DOCUMENTS

| | | | | |
|---|---|---|---|---|
| 2,400,544 | A * | 5/1946 | Kline et al. | 205/52 |
| 3,001,571 | A * | 9/1961 | Hatch | 428/292.1 |
| 3,012,928 | A * | 12/1961 | Whitman | 162/135 |
| 3,118,789 | A * | 1/1964 | Wiswell et al. | 346/135.1 |
| 3,148,107 | A * | 9/1964 | Selke et al. | 162/132 |
| 3,367,851 | A * | 2/1968 | Filreis et al. | 205/52 |
| 3,632,437 | A | 1/1972 | Trimble | |
| 4,180,434 | A * | 12/1979 | Ciani et al. | 162/138 |
| 4,347,104 | A * | 8/1982 | Dressler | 162/103 |
| 4,645,717 | A * | 2/1987 | Berbeco | 428/503 |
| 4,948,463 | A * | 8/1990 | Kinsley, Jr. | 162/138 |
| 6,540,874 | B1 * | 4/2003 | Ling-Chen | 162/138 |
| 6,558,754 | B1 | 5/2003 | Velin et al. | |
| 8,172,982 | B2 * | 5/2012 | Ales et al. | 162/145 |
| 8,334,226 | B2 * | 12/2012 | Nhan et al. | 442/349 |
| 8,381,536 | B2 * | 2/2013 | Nhan et al. | 62/109 |
| 2005/0118347 | A1 | 6/2005 | Putkisto et al. | |
| 2006/0008626 | A1 * | 1/2006 | Tam | 428/209 |
| 2006/0163744 | A1 | 7/2006 | Vanheusden et al. | |
| 2006/0234576 | A1 | 10/2006 | Smith et al. | |
| 2007/0035808 | A1 | 2/2007 | Amundson et al. | |
| 2008/0265215 | A1 * | 10/2008 | Wessling | 252/500 |
| 2010/0108278 | A1 | 5/2010 | Smith et al. | |
| 2010/0112303 | A1 | 5/2010 | Smith et al. | |
| 2012/0145315 | A1 * | 6/2012 | Knaapila et al. | 156/273.9 |
| 2012/0224285 | A1 * | 9/2012 | Svasand et al. | 361/56 |
| 2012/0240992 | A1 * | 9/2012 | Svasand et al. | 136/256 |
| 2013/0264019 | A1 * | 10/2013 | Helgesen et al. | 162/102 |
| 2013/0316245 | A1 * | 11/2013 | Buchanan et al. | 429/232 |
| 2013/0320467 | A1 * | 12/2013 | Buchanan et al. | 257/419 |
| 2014/0034256 | A1 * | 2/2014 | Fujimori et al. | 162/138 |

FOREIGN PATENT DOCUMENTS

| | | | |
|---|---|---|---|
| WO | WO 8400985 | A1 * | 3/1984 |
| WO | 92 05567 | | 4/1992 |
| WO | 98 47705 | | 10/1998 |
| WO | 99 62076 | | 12/1999 |
| WO | WO 03082948 | A1 * | 10/2003 |
| WO | WO 2006002014 | A1 * | 1/2006 |
| WO | WO 2008013570 | A2 * | 1/2008 |
| WO | WO 2010151141 | A1 * | 12/2010 |
| WO | WO 2012081991 | A1 * | 6/2012 |

OTHER PUBLICATIONS

Norwegian Search Report Issued Jul. 15, 2011 in Norwegian Patent Application No. 20101760 Filed Dec. 15, 2010.

International Search Report Issued Mar. 9, 2012 in PCT/NO11/00344 Filed Dec. 14, 2011.

* cited by examiner

METHOD FOR FORMING AN ANISOTROPIC CONDUCTIVE PAPER AND A PAPER THUS FORMED

TECHNICAL FIELD

The invention concerns a method for treating or manufacturing a paper to provide at least a part of it with anisotropic electric conductivity as well as a paper so produced.

BACKGROUND OF THE INVENTION

Electrically conductive cellulose containing materials can be based on the mixture of cellulose containing matrix and conductive particles (fillers) embedded into this matrix. In the former case the matrix can also contain organic or inorganic additives and the electrically conductive particles be either carbon particles, metal particles or metal oxide particles. The materials can also be directionally conductive.

Conductive papers are proposed for applications in energy storage.

In PNAS 2009 106 21490 is described how conductive paper is prepared by using commercially available paper and conductive carbon and silver particles. This paper act as a capacitor with very high capacitance (200 F/g) and specific energy (7.5 Wh/kg). This stems from the fact that the material is significantly lighter than corresponding capacitors with metal framework.

Conductive papers are proposed for applications in electromagnetic interference (EMI) shielding.

In Compos. Sci. Tech. 2010 70 1564 is described how carbon nanotube/cellulose composites incorporated into the paper making lead to a paper with EMI shielding properties. Typically 10 wt-% carbon content is required to achieve a composite paper with sufficient 20 dB far-field EMI shielding effectiveness.

Conductive papers contain typically large amount of conductive particles.

In U.S. Pat. No. 3,367,851 is described how electrically conductive paper can be prepared from electrically conductive carbonaceous fibers and wood pulp. The fraction of conductive component varied from 2 to 35 wt-%.

In U.S. Pat. No 4,347,104 is described the electrically conductive paper with the fraction of conductive carbonaceous component from 1 to 35 wt-%.

In U.S. Pat. No. 3,998,689 is described a carbon fiber paper where the ratio of carbon fibers falls in the range of 40-90 wt-%.

One problem with these techniques is that one has to use lots of conductive fillers like carbon. These relatively high fractions of conductive fillers are problematic for a variety of reasons. Another problem is that the sizes of the conductive fibers are limited. Long conductive carbon fibers would be beneficial for applications seeking to reduce electromagnetic interference. However, if the fibers are too long one can have problem getting the fibers dispersed.

OBJECTIVES

It is an object of the present invention to provide a conductive paper with significantly lower filler fraction.

It is also an object of the present invention to provide a paper which exhibits, at least in parts thereof, anisotropic electric conductivity.

It is furthermore an object to provide a method for treating a paper to provide at least a part of it with anisotropic electric conductivity and/or a method for forming a paper with anisotropic electric conductivity.

It is a still further object to provide such paper with means that are inexpensive and reliable in industrial scale manufacturing or preparations.

DESCRIPTION OF THE INVENTION

The above mentioned objects are achieved by the present invention which in a first aspect has the form of a method for treating already manufactured paper.

According to a second aspect the invention concerns a method for forming paper with anisotropic electric conductivity from a cellulose dispersion.

According to a third aspect the present invention concerns a paper.

Preferred embodiments of the invention are disclosed.

It should be emphasized that the term "paper" as used herein is not restricted with respect to its thickness, only with respect to the material as such.

In conducting the process of producing paper from a cellulose dispersion, a person skilled in the art will understand that any mechanical or other treatment which the cellulose dispersion is typically subjected to under such a process, may also be included in the present process without being specifically mentioned here.

The steps will typically be performed in sequence, but some variations may occur. For instance, the step of applying an electric field will usually not be terminated when the next step is initiated, and may, but need not, continue until a mainly dry paper product is obtained.

In a preferred embodiment of the first aspect of the invention, the paper is, as the first characterizing step, soaked in the non-aqueous, liquid dispersion.

In a preferred embodiment of the second aspect of the invention, the cellulose dispersion is an industrial paper pulp and the cellulose dispersion may contain organic or inorganic additives which are common in the paper manufacturing industry.

While typically the entire paper treated or produced is provided with that the anisotropic electric conductivity, in some cases the anisotropic electric conductivity is restricted to one or more areas smaller than the paper treated or produced.

It is important that the concentration of conductive particles in the liquid dispersion thereof can be comparatively low and for many applications well below the percolation threshold of the corresponding isotropic dispersion.

This makes paper less expensive and in some cases its preparation is easier.

When the electric field is applied to the liquid dispersion, be it applied to a manufactured paper or to a cellulose dispersion, the conductive particles start to align with the electric field. If an AC source is used, the particles are generally aligned symmetrically from both sides of the "matrix" in which the particles are confined, forming long strings parallel to the electric field. According to one embodiment these mainly mutually parallel conductive pathways are directed perpendicular to the two largest dimensions of the paper. In another embodiment, however, dependent upon the application and the positioning of the electrodes, the mainly mutually parallel conductive pathways are parallel to a plane formed by the two largest dimensions of the paper.

A special effect may be obtained by using a DC current. In this case strings of conductive particles will start growing from just one side, i.e. shorter strings that will eventually build a conductive network mainly sideways at the surface from which the strings started to grow. In this case the strings thus assume the shape of a branched structure that extends mainly transverse to that of the electric field applied and the obtained conductivity becomes two-dimensional and mainly perpendicular to the direction of the applied electric field. Its direction or directions are still determined by that of the electric field but not coinciding with the electric field.

Such dispersion may contain small amount of water but it should be a minority component to avoid hydrolysis by electric field. Alternatively the field should be very low.

The step of eliminating the dispersion agent is typically conducted by mechanically removing part of it and thereafter evaporating the remaining parts. It is also feasible that the dispersion agent may be a monomer which is eliminated by its polymerization to a solid material.

If the solvent is volatile enough, it is also possible to rely only on evaporation process.

The conductive particles are infusible particles such as carbon particles, metal oxide particles, metal coated particles, or metal particles. It is preferred that the particles generally have a low aspect ratio, i.e. they are not fibre-like or extremely elongate in one direction. The particles may be spherical but are more typically irregular of any random shape. Particles of more regular shape, other than spherical, may also be used, e.g. disc shaped particles having to dimensions more or less equal and a third dimension which is smaller. The term "low aspect ratio" as used herein refers to aspect ratios lower than 20, preferably lower than 10 and more preferably lower than 5, the aspect ratio defined as the largest linear dimension of a particle divided by the largest linear dimension perpendicular to said largest dimension The cellulose dispersion according to the second aspect of the present invention can contain one or several optional components, typically components commonly used in paper manufacturing, provided such components do not negatively interact with the system, e.g. make the conductive particles settle or agglomerate. Such components may be added at any stage of the process, before or after the addition of conductive particles or together with the conductive particles. The cellulose system is characteristically lyotropic which means that the cellulose/paper can be plasticised by solvent and solidified by evaporating this solvent partly or fully. A person skilled in the art will understand that minor amounts of fibres other than cellulose fibres can also be included as long as their properties are compatible with cellulose. Even carbon nanofibres may be added to the cellulose dispersion in limited concentrations.

The electric field can be created between one or more pairs of electrodes that can be placed either in direct contact with one or both sides of the cellulose dispersion or paper or outside additional insulating layers, where the insulating layers are placed in contact with the cellulose dispersion or paper; or that may not be in direct contact with the cellulose dispersion or paper. Typically, at least one electrode, and preferably all of the electrodes, has/have the shape of an open grid to allow fluid to pass therethrough.

The direction of the electric field can be predetermined by the electrode arrangement and thereby the direction of the electric connections formed by the aligned conductive particles can be controlled.

The electric field applied can be in the order of 0.05 to 10 kV/cm, or more specifically 0.1 to 5 kV/cm. This means that for a typical alignment distance in the range of 10 □m to 1 mm, the voltage applied can be in the range of 0.1 to 100 V. The field is typically an alternating (AC) field, but can also, for specific purposes, be a direct (DC) electric field. A typical field is an AC field having a frequency of 10 Hz to 10 MHz. Very low frequencies <10 Hz or DC fields lead to asymmetric chain formation and build up. The low voltage needed for applying the method is simple to handle in a production line and does not need the specific arrangements necessary when handling high voltages.

Thus, the present invention is based on the finding that it possible to align conductive particles in lyotropic cellulose matrices using an electric field to form particle pathways. The pathways are able to enhance the macroscopic conductivity of the material. In particular, the formation of conductive pathways allows the material to become conductive also when it contains a lower amount of conductive particles than is otherwise necessary for creating electrical contact for the material having randomly distributed particles. The amount of conductive particles in the cellulose matrix could thereby be reduced and be up to 10 times lower than the isotropic percolation threshold or even lower.

Moreover, this procedure renders anisotropic material and directional conductivity that is higher along the alignment direction(s) than perpendicular to same. The anisotropic conductive properties may be exhibited by the entire paper or to one or more limited areas thereof. The conductivity may be unidirectional or assume the form of a layer restricted to one side of the paper. More typical the conductivity is unidirectional and aligned across the paper thickness.

The method can be used to produce electric conductive paper which has a wide range of applications. One of these applications is preventing or reducing electromagnetic interference (EMI) by using the paper as shielding. Another application is to use the paper for electric shielding, electrostatic discharge (ESD) material, in batteries, capacitors and as high-performance energy storage devices such as super-capacitors. Frequency identification tags may also be a possible application in the future as well as for providing watermarks in paper or even "intelligent" functionality" in papers of different kinds, such as security control mechanisms for bank notes. Many other future applications may be feasible and the present invention is not restricted to certain uses or applications.

If significant amounts of conductive particles are used in a paper, negative effects on the paper properties may occur, such as the paper becoming more stiff and brittle. A particular advantage of the present invention is that the anisotropic electric conductivity is obtainable at such low particle concentration that negative effects on the cellulose structure by the presence of particles, is neglectable.

LIST OF DRAWINGS

DETAILED DESCRIPTION OF THE INVENTION

In all embodiments, the method comprising the mixing of infusible conductive particles and fluid matrix that contains at least cellulose and solvent, the electric field alignment of conductive particles mixed in this fluid and the control of the viscosity of this mixture by evaporating solvent off. This procedure can be done using opposite electrodes for example in in-plane geometry or out-of-plane geometry, illustrated in FIGS. 1 and 2, respectively.

The resultant aligned material retains anisotropic properties such as directional electrical conductivity. In this way, aligned conductive microstructures of originally infusible particles which do not allow alignment as such are formed.

The invention will be further described by the following examples. These are intended to embody the invention but not to limit its scope.

Example 1

Figure 1:
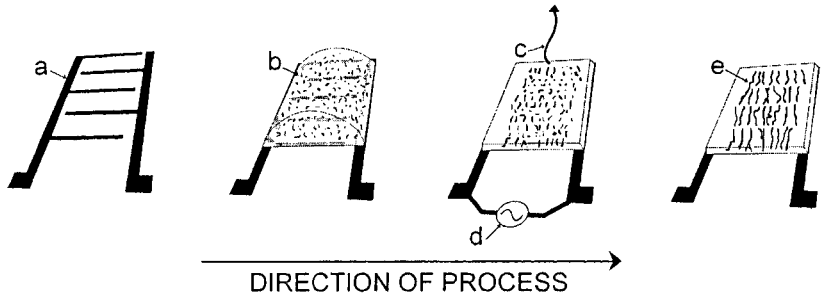
FIG. 1 shows schematics of the employed alignment procedures for in-plane alignment. This displays orientation electrodes, a, lyotropic mixture, b, evaporation of solvent, c, by alternating electric field, d, and thus obtaining aligned conducting pathways in the solid material, e.
Figure 2:
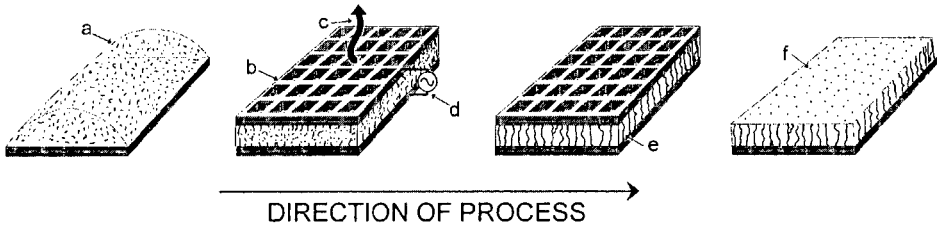
FIG. 2 shows schematics of the employed alignment procedures for out-of-plane alignment. This displays lyotropic mixture, a, on the bottom electrode, top-electrode electrode with holes, b, evaporation of solvent, c, by alternating electric field, d, and thus obtaining aligned conducting pathways in the solid material, e, that can be free-standing, f, after removal of one or both electrodes.
Figure 3:
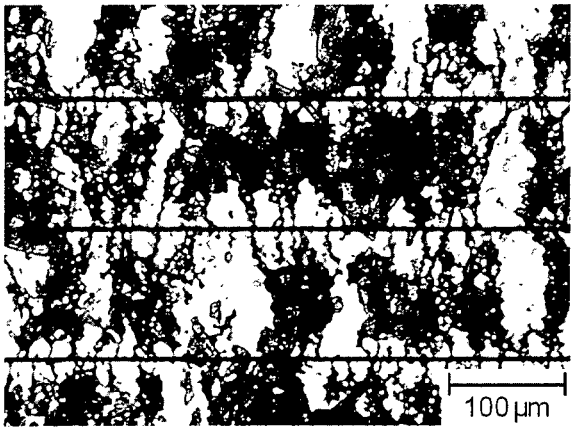
FIG. 3 shows transmitted light optical micrograph of aligned material for a filler fraction at or above the corresponding isotropic percolation threshold.

This example is referred to FIG. 1 and FIG. 3. The example concerns the preparation of a mixture of conductive particles that in this example are carbon particles and cellulose containing matrix that in this example contains solvent being thus lyotropic dispersion; as well as alignment of these particles so that the aligned particles form conductive paths resulting in a conductive material, whose conductivity is directional; and subsequent evaporation of solvent so that the aligned material is stabilized and the conductivity maintained.

In this procedure 2.78 wt-% (or ~0.7 vol-%) microcrystalline cellulose powder with a particle size of 20 μm (Sigma-Aldrich) was mixed with graphene platelets with the lateral size of less than 5 μm (Angstron Materials). These two components were first mixed with 1-propanol, 1 part of cellulose and graphene in 6 parts alcohol. The cellulose powder and the graphene were uniformly dispersed in the alcohol.

The lyotropic mixture was spread on top of interdigitated electrodes with a spacing of 100 μm and area of 0.5 $cm^2$.

A voltage of 19 V with a frequency of 1 kHz, thus corresponding to electric field of 1.9 kV/cm, was applied for about 3 minutes.

Most of the solvent was evaporated in about 30 seconds. The graphene platelets aligned into chain-like formations over this period. FIG. 3 shows optical micrograph of the aligned platelets in cellulose in the end of period.

The resistance before alignment is in the order of MΩ's, the resistance was about 200Ω after the alignment. The latter resistance corresponds to the DC conductivity of $\sim 5 \cdot 10^{-3}$ S/m.

Example 2

This example concerns scalability of particle fraction and its influence on the resultant conductivity.

The procedure was otherwise similar to that in Example 1, cf. FIG. 1, but graphene concentration of ~0.4 vol-% was employed. The material behaved similarly as in Example 1. The resistance was MΩ's before alignment and 10 kΩ after alignment.

Figure 4:
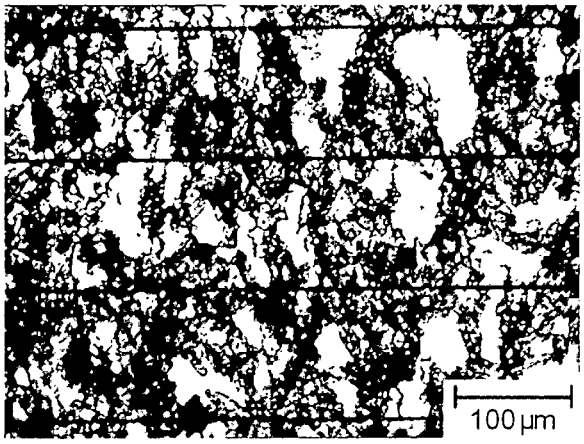
FIG. 4 shows transmitted light optical micrograph of aligned material for a filler fraction an order of magnitude below the corresponding isotropic percolation threshold.

FIG. 4 shows alignment of ~0.4 vol-% (black) graphene platelets in (white) cellulose as taken by transmitted light.

Figure 5:
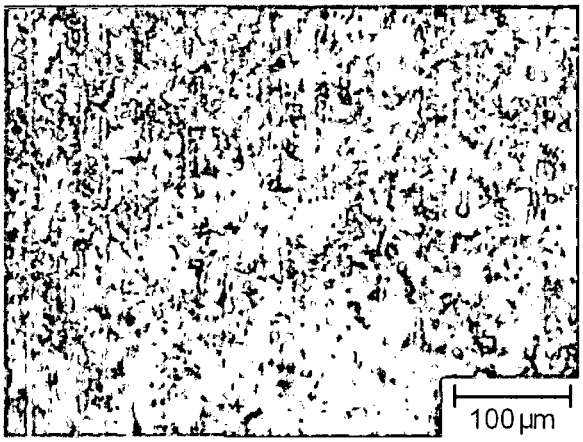
FIG. 5 shows optical micrograph of aligned material as seen in reflected light. The electrode configuration is as in FIG. 4.

FIG. 5 shows micrograph of the surface showing a good dispersion of the graphene platelets.

Example 3

This example concerns addition of inorganic additive to the mixture without adverse effect on the alignment.

Following the same procedure as in Example 1 and 2 but now clay was mixed with the microcrystalline cellulose powder and graphene platelets. The clay used was Laponite RD (Rockwood). The overall mixture contained 62.5 wt-% (~90 vol %) cellulose 35 wt-% (~9.6 vol %) clay and 2.5 wt-% (~0.4 vol %) graphene. This solution was mixed as 1 part in 4 parts 1-propanol.

The resistance was 2 MΩ before alignment and 170 kΩ after in-plane alignment and evaporation.

This result shows that the cellulose and graphene solution was still conducting after mixing it with an inorganic material like clay.

Example 4

This exemplifies alignment of metal particles.

The materials were prepared and the alignment was performed as in Examples 1, 2, 3 and 4 but silver particles (Sigma-Aldrich) with the size of 10 μm were used instead of graphene platelets.

The alignment occurred as in Examples 1, 2, 3, and 4 but the obtained conductivity was higher, typically 100 times higher.

Example 5

This exemplifies alignment on existent paper or a cellulose containing sheet, cf. FIG. 1.

The alignment was performed as in Examples 1, 2, 3 and 4 but the lyotropic mixture was poured on to the paper sheet that was put on the interdigitated alignment electrodes. To ensure fairly uniform field on top of the sheet, the electrode spacing was selected to be larger than the sheet thickness. For instance 200 μm and 80 μm were used for spacing and sheet thickness, respectively.

Alignment occurred as described in Examples 1, 2, 3 and 4 and the paper was conductive in-plane.

Example 6

This example shows alignment through existent paper or a cellulose containing sheet.

The alignment was performed as in Examples 1, 2, 3 and 4 but the lyotropic mixture was poured on to the paper sheet that was on a flat sheet-like bottom electrode. A sheet-like top electrode was then placed on the sample Alignment occurred as described in Examples 1, 2, 3 and 4, the particle pathways were formed through the porous structure and the paper was conductive out-of-plane.

In order to achieve efficient evaporation the electrodes can also contain holes or they can be mesh-like and the solvent can get evaporated via these holes.

The invention claimed is:

1. A method for treating a paper to provide at least a part of the paper with anisotropic electric conductivity, comprising applying to the paper a dispersion comprising a non-aqueous, liquid dispersing agent and electrically conductive particles, applying an electric field over at least part of the paper, so that a number of the conductive particles are aligned with the field, thus creating electrically conductive pathways;

wholly or partially eliminating the dispersing agent and allowing the paper to dry thereby stabilizing and preserving the electrically conductive pathways in the paper.

2. The method in accordance with claim 1, wherein the paper is soaked in a liquid dispersion.

3. The method in accordance with claim 1, wherein the electric field is generated between one or more pairs of alignment electrodes.

4. The method in accordance with claim 3, wherein at least one of the alignment electrodes is in direct contact with the paper.

5. The method in accordance with claim 3, wherein at least one electrode has the shape of an open grid to allow fluid to pass therethrough.

6. The method in accordance with claim 3, wherein the alignment electrodes are insulated from the paper.

7. The method in accordance with claim 1, wherein the electric field is in the order of 0.05-10 kV/cm.

8. The method in accordance with claim 1, wherein the electric field is an AC field.

9. The method in accordance with claim 1, wherein the electric field is a DC field for producing conductivity in a direction mainly perpendicular to the direction of the electric field.

10. The method in accordance with claim 1, wherein the amount of the conductive particles in the liquid dispersion is below the percolation threshold of the corresponding isotropic dispersion.

11. The method in accordance with claim 1, wherein the conductive particles are selected from the group consisting of metal particles, metal oxide particles and carbon particles, and have an aspect ratio lower than 20.

12. The method in accordance with claim 11, wherein the particles have an aspect ratio lower than 10.

13. The method in accordance with claim 11, wherein the conductive particles have an aspect ratio lower than 5.

14. The method in accordance with claim 1, wherein the electric field is in the order of 0.1-5 kV/cm.

15. The method according to claim 1, wherein the paper is a cellulose paper.

16. The method according to claim 1, wherein the paper is a cellulose matrix.

17. The method according to claim 1, wherein the paper does not comprise any inorganic filler.

18. The method according to claim 1, wherein the electrically conductive particles are present in and on the paper.

19. The method according to claim 1, wherein the electrically conductive pathways have a DC conductivity of from $5\times10^{-3}$ to $5\times10^{-1}$ S/m.

20. A method for forming a paper with anisotropic electric conductivity, comprising forming a non-aqueous cellulose dispersion comprising conductive particles, spreading the cellulose dispersion and applying an electric field over at least part thereof to allow a number of the conducting particles to align and form conductive pathways, allowing the cellulose dispersion to dry, thereby stabilizing the electric conductive pathways formed in the thus formed paper.

21. The method in accordance with claim 20, wherein the cellulose dispersion is an industrial paper pulp.

22. The method in accordance with claim 20, wherein the cellulose dispersion contains organic or inorganic additives.

23. The method in accordance with claim 20, wherein the paper is soaked in a liquid dispersion.

24. The method in accordance with claim 20, wherein the electric field is generated between one or more pairs of alignment electrodes.

25. The method in accordance with claim 24, wherein at least one electrode has the shape of an open grid to allow fluid to pass therethrough.

26. The method in accordance with claim 24, wherein the alignment electrodes are insulated from the cellulose dispersion.

27. The method in accordance with claim 24, wherein at least one of the alignment electrodes is in direct contact with the cellulose dispersion.

28. The method in accordance with claim 20, wherein the electric field is in the order of 0.05-10 kV/cm.

29. The method in accordance with claim 20, wherein the electric field is in the order of 0.1-5 kV/cm.

30. The method in accordance with claim 20, wherein the electric field is an AC field.

31. The method in accordance with claim 20, wherein the electric field is a DC field for producing conductivity in a direction mainly perpendicular to the direction of the electric field.

32. The method in accordance with claim 20, wherein the amount of the conductive particles in the liquid dispersion is below the percolation threshold of the corresponding isotropic dispersion.

33. The method in accordance with claim 20, wherein the conductive particles are selected from the group consisting of metal particles, metal oxide particles and carbon particles, and have an aspect ratio lower than 20.

34. The method in accordance with claim 20, wherein the electric field is generated between one or more pairs of alignment electrodes in contact with the cellulose dispersion.

35. The method in accordance with claim 20, wherein the electric field is generated between one or more pairs of alignment electrodes that are insulated from the cellulose dispersion.

* * * * *